United States Patent [19]

Nakamura

[11] 3,955,233

[45] May 11, 1976

[54] TOILET UTENSIL FOR APPLYING TOILETRIES

[76] Inventor: Kenji Nakamura, No. 5-47, Shimo-Shinjo, Higashi-Yodogawa, Osaka, Osaka, Japan

[22] Filed: July 16, 1974

[21] Appl. No.: 488,922

[30] Foreign Application Priority Data

July 21, 1973 Japan ..... 48-85860[U]
May 8, 1974 Japan ..... 49-51816[U]

[52] U.S. Cl. ..... 15/209 R; 132/DIG. 3
[51] Int. Cl.[2] ..... A47K 7/02; A45D 40/26
[58] Field of Search ..... 15/209 R; 132/88.7, 132/DIG. 3; 273/58 K; 46/87

[56] References Cited

UNITED STATES PATENTS

| | | | |
|---|---|---|---|
| 793,657 | 7/1905 | Hardy | 15/209 R |
| 1,006,741 | 10/1911 | Ferry | 15/209 R |
| 1,378,931 | 5/1921 | Adler | 15/209 R |
| 1,439,734 | 12/1922 | Guinzburg | 15/209 R |
| 1,565,775 | 12/1925 | Bash | 15/209 R |
| 1,867,437 | 7/1932 | Aste | 15/209 R |
| 2,390,921 | 12/1945 | Clark | 132/DIG. 3 |
| 2,932,052 | 4/1960 | Morse | 15/209 R |
| 3,048,395 | 8/1962 | Hobbs | 46/87 |

FOREIGN PATENTS OR APPLICATIONS

| | | | |
|---|---|---|---|
| 1,255,137 | 1/1961 | France | 15/209 R |

*Primary Examiner*—Richard E. Aegerter
*Assistant Examiner*—Richard R. Stearns
*Attorney, Agent, or Firm*—Woodhams, Blanchard and Flynn

[57] ABSTRACT

A toilet utensil for applying viscous toiletries comprising a sealed pouch which is made of a flexible and thin film and is filled with air or an elastic material.

1 Claim, 7 Drawing Figures

TOILET UTENSIL FOR APPLYING TOILETRIES

BACKGROUND OF THE INVENTION

1. Field of the Invention

The present invention is concerned with improvement of a toilet utensil to be used for uniformly applying viscous toiletries.

2. Description of the Prior Art

Conventional toilet utensils for applying toiletries were made of porous and spongy materials, and therefore were effective to some extent in respect of uniformly applying viscous toiletries to the skin. However, the use of such conventional toilet utensils have been defective in various points, for instance, in that large amounts of toiletries are absorbed by said toilet utensils, resulting in waste of toiletries, and in that such absorbed toiletries are removed at best with extreme difficulty from the toilet utensils when relying on a simple washing, thus being accompanied by inconvenience in handling and harmfulness for sanitary reasons.

SUMMARY OF THE INVENTION

The present invention is related to a toilet utensil for applying toiletries comprising a pouch which is made of a flexible and thin film and is filled with air or an elastic core.

DESCRIPTION OF THE PREFERRED EMBODIMENTS

In FIG. 1-A, the numeral 1 depicts a generally ellipsoidal in particular egg-shaped, plastic pouch which is packed with air and air-tight, and the numeral 2 depicts napping or pear skin-like dense unevenness formed on the surface 1' of said pouch. The toilet utensil illustrated in FIG. 1-A is utilized in such a manner as the egg-shaped pouch 1 is held in hand and moved over the skin to spread toiletries which have been applied to the skin.

In thus handling the pouch 1, it deforms well along the configuration of the face and, further, the uneven surface 1' of the pouch comes into contact with the skin with a moderate elasticity, whereby the toiletries present on the face can be applied uniformly as well as evenly. FIG. 1-B depicts an air-packed and air-tight pouch 1 modified to have an elliptical, rather than egg-shaped, sectional configuration, and FIG. 1-C and FIG. 1-D each depict a pouch 1 which is equipped with a grip handle 3 and 3A, respectively at the side and modified so as to be convenient for use.

Figure 1A:
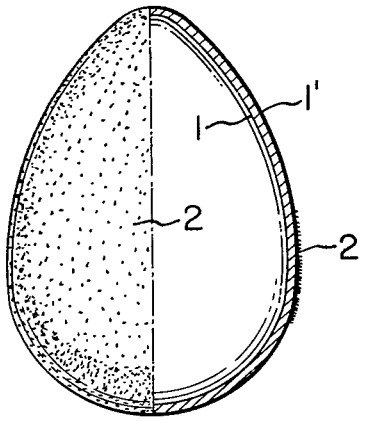
FIGS. 1 A to D are each a partially cutaway sectional view of a toilet utensil belonging to a type comprising a pouch filled with air.
Figure 1B:
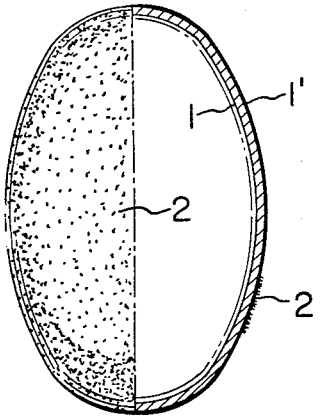
Figure 1C:
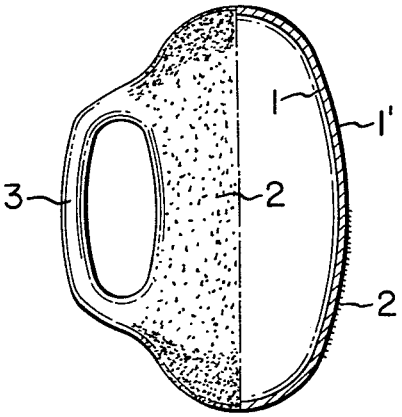
Figure 1D:
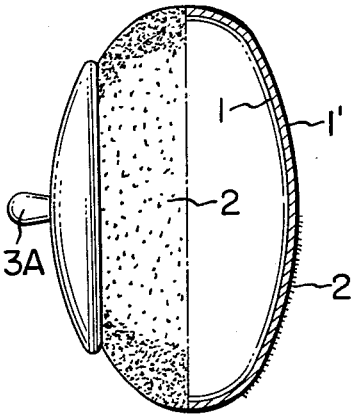
Figure 2:
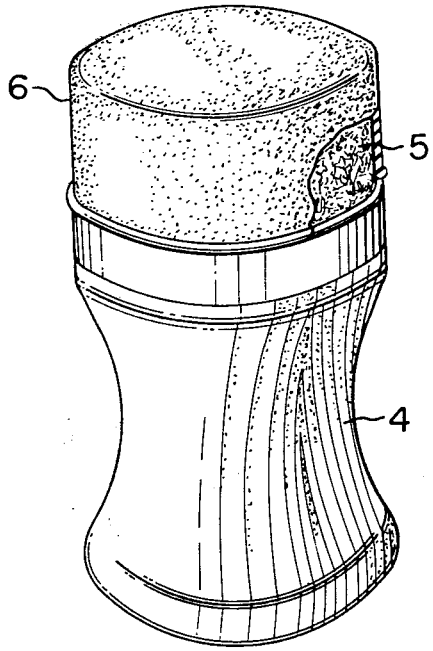
FIG. 2 and FIG. 3 are respectively a partially cutaway oblique view and a partially cutaway sectional view of a toilet utensil belonging to a type comprising a pouch including an elastic core therein.
Figure 3:
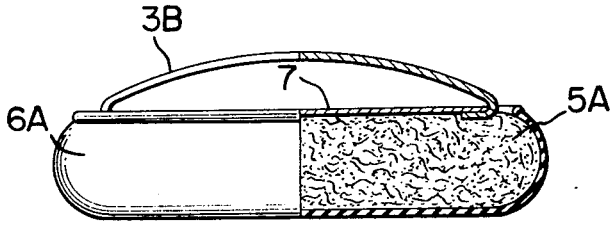
Figure 4:
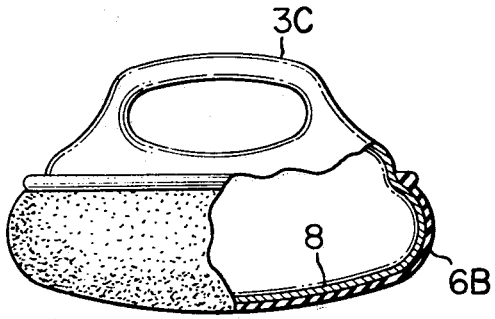
FIG. 4 is a partially cutaway sectional view of a different embodiment of a toilet utensil.

In FIG. 2, the numeral 4 depicts a shank, the numeral 5 depicts a core having a moderate elasticity such as sponge or felt mounted on the upper end of the shank, and the numeral 6 depicts a flexible cover wrapping the surface of the core, which cover comprises natural rubber or a soft plastic membrane or film. The manner of using a thus constructed toilet utensil will be self evident from the above explanations. FIG. 3 depicts a toilet utensil which comprises a base board 7 equipped with a grip handle 3B, a core 5A mounted on said base board, and a cover 6A wrapping the surface of said core. FIG. 4 depicts a toilet utensil which comprises a hollow and elastic core 8 which was molded integrally with a grip handle 3C similar to handle 3 of FIG. 1C and a cover 6B which wraps the surface of said core. The surface of the cover 6B may be either smooth or pear skin-like. Where the cover is smooth, it makes it possible to apply toiletries very thinly. Where the cover is pear skin-like, it permits application of toiletries somewhat thickly. Accordingly, the cover preferably is detachable and has a smooth surface and a pear skin-like back. Thus both sides can be used selectively as occasion demands, which is very convenient to users. The toilet utensil according to the present invention does not absorb toiletries thereinto, thereby eliminating waste of toiletries, and further as toiletries adhered to the surface can easily be wiped away therefrom after use there result various advantages such as no need for washing, which was necessitated in the case of conventional sponge, convenience in handling and in addition suitability for reasons of sanitation.

What is claimed is:

1. A toilet utensil for applying toiletries, comprising:

a hollow elastic core having a substantially elliptical cross section holder portion and an integrally molded handle portion extending from one side of said holder portion, said core consisting of a single layer of flexible airtight film forming a continuously curved airtight body, said handle portion having a central part spaced from said holder by a hand receiving opening bounded by exterior surface portions of said handle portion and holder portion, the ends of said handle portion engaging the holder portion at spaced locations on said side thereof;

a filling for said core consisting of a quantity of gas packed in said core and supporting said film layer to shape said handle portion and holder portion;

a one-piece substantially cup shaped cover having a substantially uniform thickness throughout its area except for an enlarged cross section rim at the open end thereof, the diameter of the rim being less than the major diameter of the cup shaped cover and core holder portion, said cover being removably but snugly fitted over the holder portion of said core with said rim engaging said core intermediate the maximum width part of the holder portion and said handle portion to retain said cover on said core, the inner and outer surfaces of said cover being reversible and differently textured, one said surface being substantially smooth faced for spreading toiletries relatively thinly and the other being substantially pear skin-like for spreading toiletries relatively thickly, wherein such surfaces are alternatively usable by removal of the cover from the core, turning said cover inside out and replacing said cover on said core, said cover being of material nonabsorbent of said toiletries.

* * * * *